US007550659B2

(12) United States Patent
Shimoda

(10) Patent No.: US 7,550,659 B2
(45) Date of Patent: Jun. 23, 2009

(54) KEYBOARD APPARATUS

(75) Inventor: Yoshiaki Shimoda, Shizuoka-ken (JP)

(73) Assignee: Kabushiki Kaisha Kawai Gakki Seisakusho, Shizuoka-Ken (JP)

( * ) Notice: Subject to any disclaimer, the term of this patent is extended or adjusted under 35 U.S.C. 154(b) by 0 days.

(21) Appl. No.: 11/768,286

(22) Filed: Jun. 26, 2007

(65) Prior Publication Data

US 2008/0121090 A1 May 29, 2008

(30) Foreign Application Priority Data

Jun. 27, 2006 (JP) ..... 2006-176874

(51) Int. Cl.
*G10H 1/34* (2006.01)

(52) U.S. Cl. ..... 84/251; 84/252

(58) Field of Classification Search ..... 84/251, 84/252

See application file for complete search history.

(56) References Cited

U.S. PATENT DOCUMENTS 3,240,095 A * 3/1966 Steinway ..... 84/251
5,406,875 A * 4/1995 Tamai et al. ..... 84/433
5,509,340 A * 4/1996 Kawamura ..... 84/236
5,511,454 A * 4/1996 Jones et al. ..... 84/236
5,542,332 A * 8/1996 Tamai et al. ..... 84/435
5,911,167 A * 6/1999 Jones et al. ..... 84/236
6,191,351 B1 * 2/2001 Niitsuma ..... 84/720
6,617,502 B2 * 9/2003 Suzuki et al. ..... 84/423 R
6,653,542 B2 * 11/2003 Suzuki et al. ..... 84/423 R
2002/0038595 A1 * 4/2002 Suzuki et al. ..... 84/423 R
2002/0046640 A1 * 4/2002 Kondo ..... 84/615
2002/0194982 A1 * 12/2002 Suzuki et al. ..... 84/423 R
2005/0284279 A1 * 12/2005 Wroblewski ..... 84/239
2008/0121090 A1 * 5/2008 Shimoda ..... 84/434

FOREIGN PATENT DOCUMENTS

JP 2003005753 8/2003

* cited by examiner

*Primary Examiner*—David S. Warren
(74) *Attorney, Agent, or Firm*—Davis & Bujold, P.L.L.C.

(57) ABSTRACT

A keyboard apparatus includes: a plurality of keys; a plurality of hammers; a first supporting portion; a second supporting portion; an interlocking mechanism. The interlocking mechanism conveys weight of the hammers respectively to rear portions of the keys, and causes an upward movement of the hammers, when front portions of the keys are depressed and the rear portions of the keys are swung upward. The interlocking mechanism is configured so as to maintain correspondence relations between depression speeds of the keys and moving speeds of the hammers within a range of inclinedable angles in which the keys are swingable when the front portions of the keys are depressed.

17 Claims, 11 Drawing Sheets

INITIAL PHASE OF KEY DEPRESSION

FINAL PHASE OF KEY DEPRESSION

FIG.4A INITIAL PHASE OF KEY DEPRESSION
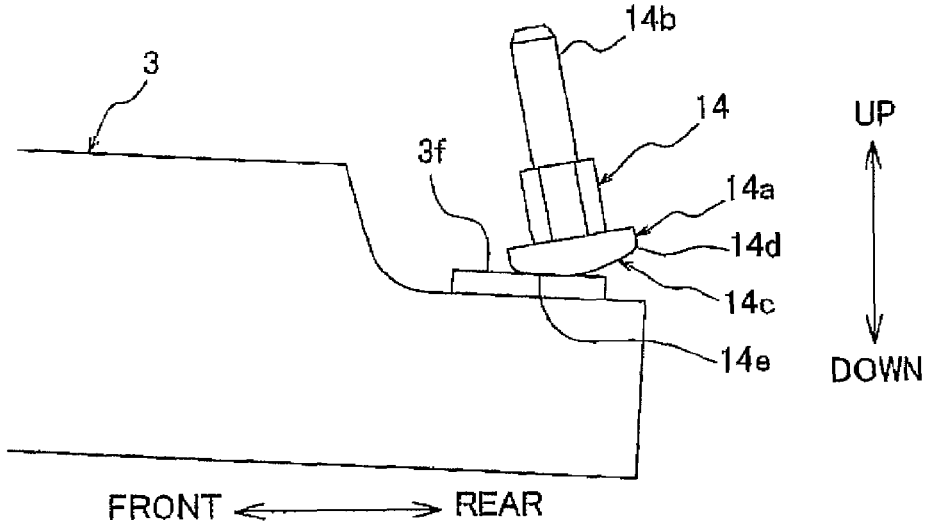
FIG.4B INTERMEDIATE PHASE OF KEY DEPRESSION
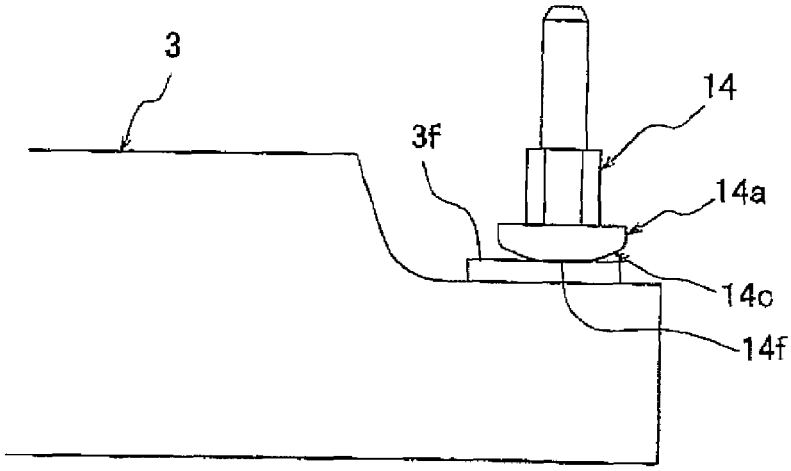
FIG.4C FINAL PHASE OF KEY DEPRESSION
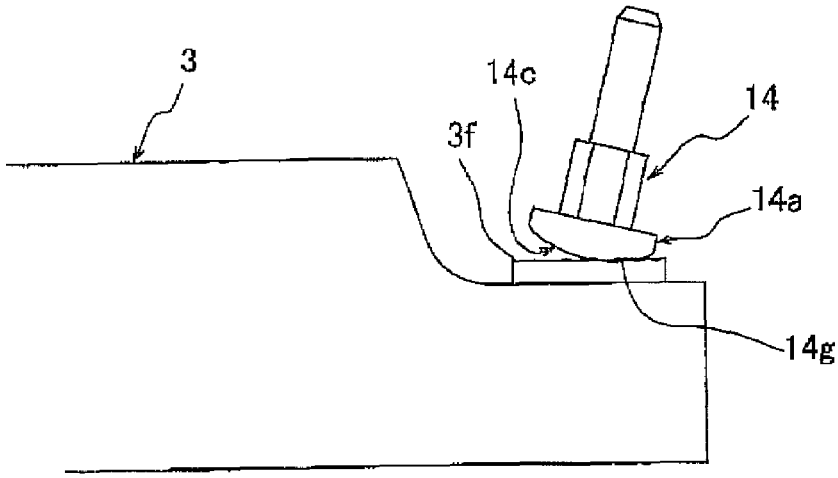

FIG.6A INITIAL PHASE OF KEY DEPRESSION
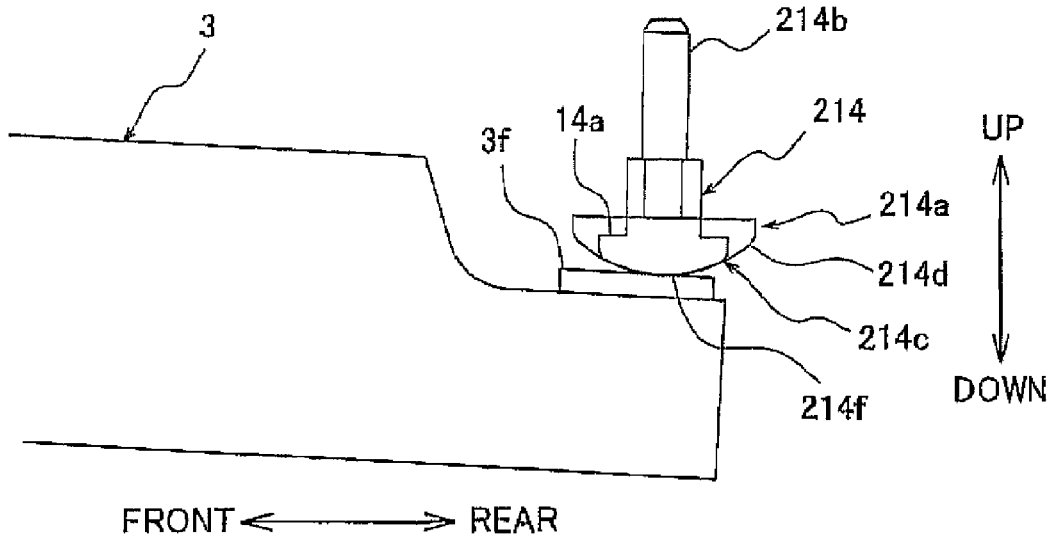
FIG.6B FINAL PHASE OF KEY DEPRESSION
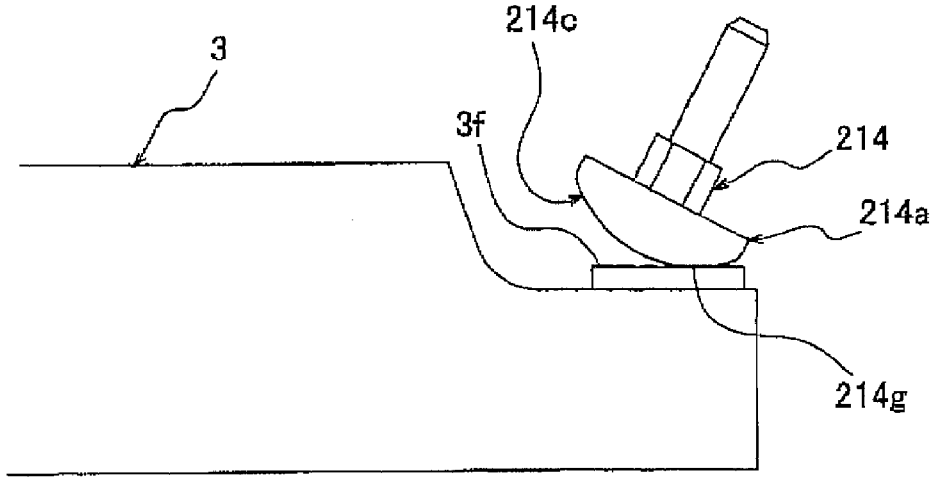

FIG.11A INITIAL PHASE OF KEY DEPRESSION
RELATED ART
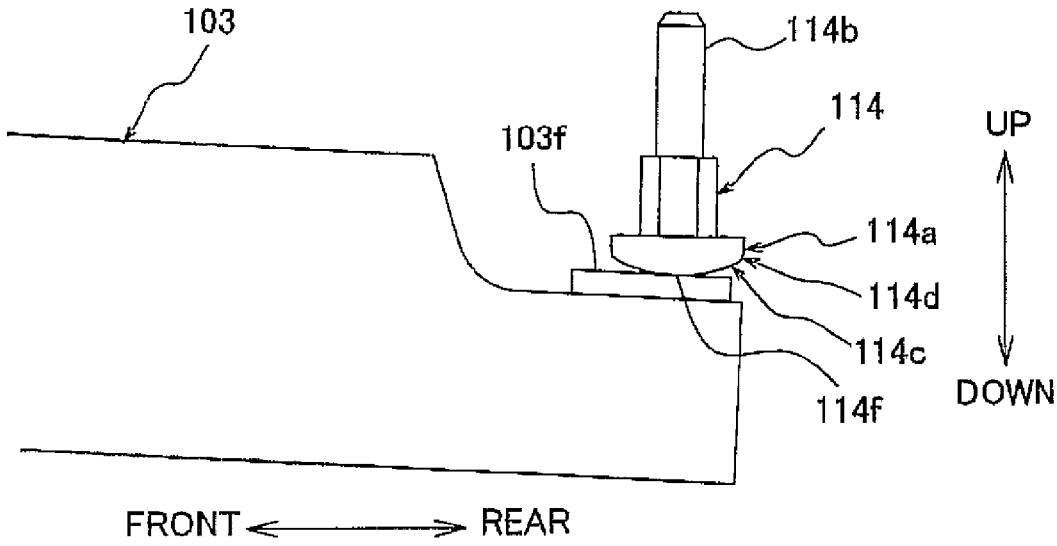
FIG.11B FINAL PHASE OF KEY DEPRESSION
RELATED ART
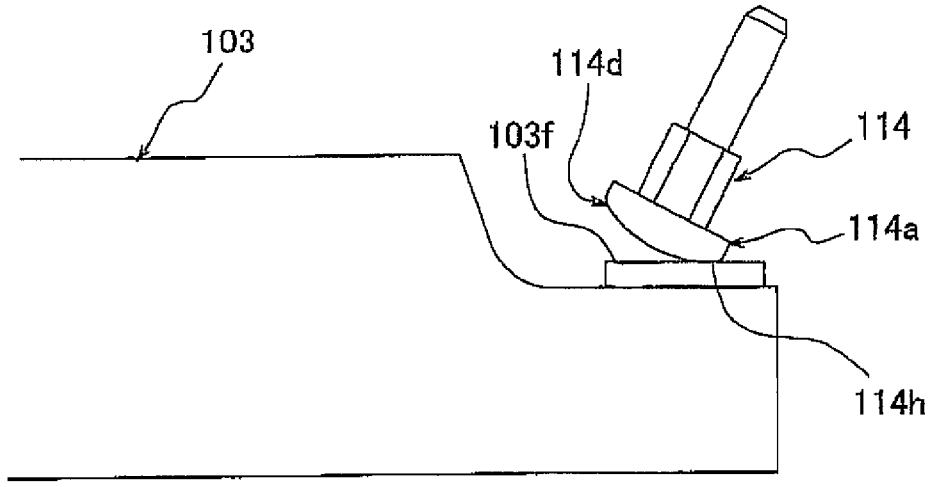

KEYBOARD APPARATUS

CROSS-REFERENCE TO RELATED APPLICATIONS

This application claims the benefit of Japanese Patent Application No. 2006-176874 filed Jun. 27, 2006 in the Japan Patent Office, the disclosure of which is incorporated herein by reference.

BACKGROUND

This invention relates to a keyboard apparatus for an electronic musical keyboard instrument, and especially to a technique for producing an appropriate sound with respect to the speed of key depression.

Among conventional keyboard apparatus for an electronic musical keyboard instruments, a keyboard apparatus 101 shown in FIG. 9 is known. The keyboard apparatus 101 includes: a plurality of keys 103 (only one key 103 having a white key 103*a* and a black key 103*b* is shown in the drawing); a lower chassis 102*a*; a rear chassis 102*b*; a plurality of hammers 104 (only one hammer 104 is shown), and a plurality of adjustment screws 114.

The lower chassis 102*a* includes a balance rail 115 and a plurality of balance pins 112. The balance rail 115 is secured to the central portion of the top surface of the lower chassis 102*a* in the front-and-rear direction. The plurality of balance pins 112 is aligned in the left-to-right direction and stand on the balance rail 115.

In the central portion of the key 103, a balance pin hole 103*e* is formed. By inserting the balance pin 112 through the balance pin hole 103*e*, the key 103 is supported by the balance pin 112 and the balance rail 115 such that the front portion of the key 103 are swingable in the up-and-down direction.

The hammers 104 are disposed above the keys 103 so as to respectively apply loads thereto, and extend forward approximately in a linear manner. In the rear end portion of the hammer 104, an arc-shaped shaft hole 104*c*, which is open backward, is formed. By the shaft hole 104*c* being engaged with a fulcrum shaft portion 102*c* of the rear chassis 102*b*, the hammer 104 is supported by the rear chassis 102*b* such that the front portion of the hammer 104 is swingable in the up-and-down direction. To the hammer 104, the adjustment screw 114 is attached in a position in vicinity of the shaft hole 104*c* disposed on the lower surface of the hammer 104.

The adjustment screw 114 includes a base portion constituted with a longitudinal shaft having a head portion 114*a* in one end, and a male thread portion 114*b* in another end. The head portion 114*a* includes a slidable curved surface 114*c* (see FIG. 11A), having one portion of a spherical body, and an edge portion 114*d* extending around the circumference of the slidable curved surface 114*c*. The male threaded portion 114*b* is engaged with a female thread portion provided to the hammer 104. The adjustment screw 114 is attached to the hammer 104 such that the height thereof can be adjusted. The hammer 104 is disposed on the top surface of the rear end portion of a corresponding key 103 such that the head portion 114*a* of the adjustment screw 114 abuts on the flat top surface of the sliding receiving member 103*f* provided on the top surface of the rear end portion of the key 103.

In a period, from when the front portion of the key 103 is not depressed (see FIG. 9) and until when the front portion of the key 103 begins to be depressed (to be referred to as an initial phase of key depression), as shown in FIG. 11A, the longitudinal shaft of the adjustment screw 114 is disposed approximately in parallel with respect to the vertical direction of the top surface of the sliding receiving member 103*f*. In this phase, the slidable curved surface 114*c* of the adjustment screw 114 slides on the top surface of the sliding receiving member 103*f* approximately in the central portion of the curved surface 114*c*. This sliding portion of the slidable curved surface 114*c* is to be referred to as the central portion 114*f*. In a state wherein the key 103 is depressed to a maximum inclined angle, to which the key 103 can be inclined at most, (to be referred to as the final phase of key depression, see FIG. 10), as shown in FIG. 11B, the longitudinal shaft of the adjustment screw 114 is inclined backward with respect to the vertical direction of top surface of the sliding receiving member 103*f*. In this phase, the head portion 114*a* of the adjustment screw 114 slides on the top surface of the sliding receiving member 103*f* in the rear portion of the edge portion 114*d* of the head portion 114*a*. This sliding portion of the edge portion 114*d* is to be referred to as a rear edge portion 114*h*. That is, when the front portion of the key 103 is depressed, the slidable curved surface 114*c* of the head portion 114*a* provided to the adjustment screw 114 slides on the top surface of the sliding receiving member 103*f* in a portion between the central portion 114*d* and the rear edge portion 114*h* of the curved surface 114*c*.

The rear chassis 102*b* extends in the left-to-right direction so as to be able to support all of the hammers 104. The rear chassis 102*b* is connected to the lower chassis 102*a*, and secured to a key bed (not shown) by a screw (not shown). The rear chassis 102*b* also extends to the up-and-down direction, and includes a substrate attachment portion 102*e* extending from the top end of the rear chassis 102*b* in an inclined manner toward the upper front side. To a leading end portion of the substrate attachment portion 102*e*, a stopper 109 is disposed so as to restrict an upward swinging movement of the hammers 104. As well as the rear chassis 102*b*, the stopper 109 extends in the left-to-right direction so as to be provided for all of the hammers 104. Above the hammers 104, a key switch 105 is disposed so as to detect key depression state regarding each of the keys 103.

The key switch 105 is connected to a control device (not shown) which controls sound production of an electric piano. The key switch 105 includes a first contact and a second contact. The first contact is turned on when the front portion of the key 103 is depressed until the key 103 is inclined to a predetermined first inclined angle. The second contact is turned on when the front portion of the key 103 is further depressed until the key 103 is inclined to a predetermined second inclined angle which is larger than the first inclined angle. When the front portion of the key 103 is depressed, a length of time between when the first contact is turned on and when the second contact is turned on is measured. As a result, a velocity (sound volume) is obtained depending on the key depression speed.

SUMMARY

However, in the keyboard apparatus 101 described above, the radius of the curvature in the rear edge portion 114*h* of the head portion 114*a* (see FIG. 11B) is configured smaller than the radius of the curvature in the central portion 114*f* of the slidable curved surface 114*c*. Thus, the frictional resistance in the rear edge portion 114*h* of the head portion 114*a* with respect to the top surface of the sliding receiving member 103*f* is larger than the frictional resistance in the central portion 114*f*. Consequently, the rear edge portion 114*h* tends to be caught on the top surface of the sliding receiving member 103*f*. For example, in a case wherein the rear edge portion 114*h* of the head portion 114*a* is caught on the top surface of the sliding receiving member 103*f* when the final phase of key depression is nearing, and then the rear edge portion 114*h* is released from the engaged state when the front portion of the key 103 is further depressed, the hammer 104 is suddenly swung. The speed of the sudden swinging of the hammer 104 is detected by the key switch 105. In this kind of case, a larger velocity (sound volume) is likely to be outputted from an electronic keyboard musical instrument, as compared to a velocity (sound volume) expected by a player. Especially if the rear edge portion 114*h* is caught when short notes, such as staccato, are played, wherein individual notes are separately and rhythmically played, the actual velocity (sound volume) tends to exceed what is expected by a player.

In one aspect of the present invention, a keyboard apparatus is preferably provided wherein sound is produced with an appropriate velocity with respect to the speed of key depression.

One aspect of the present invention preferably provides a keyboard apparatus in which sound is produced with suitable velocity with respect to key depression.

In a first aspect of the present invention, a keyboard apparatus includes: a plurality of keys; a plurality of hammers; a first supporting portion, a second supporting portion; and an interlocking mechanism. The plurality of hammers is respectively associated with the keys so as to apply load thereto. The first supporting portion supports the keys such that front portions of the keys are swingable in an up-and-down direction. The second supporting portion supports the hammers above the keys such that the hammers are movable in the up-and-down direction. The interlocking mechanism conveys weight of the hammers respectively to rear portions of the keys, and causes an upward movement of the hammers, when front portions of the keys are depressed and the rear portions of the keys are swung upward.

Moreover, the interlocking mechanism is configured so as to maintain correspondence relations between depression speeds of the keys and moving speeds of the hammers within a range of inclinedable angles in which the keys are swingable when the front portions of the keys are depressed In a keyboard apparatus configured as above, the correspondence relations between the depression speeds of the keys and the moving speeds of the hammers within the range of the inclinedable angles is maintained. Therefore, sound is produced with a suitable velocity with respect to depression of the respective keys.

The hammers may extend forward in a front-to-rear direction. Moreover, the second supporting portion may support the hammers such that front portions of the hammers are swingable in the up-and-down direction. Furthermore, the interlocking mechanism may be configured such that, when the front portions of the keys are depressed, front portions of the hammers are respectively moved upward.

In a keyboard apparatus configured as above, the rear portions of the hammers are not swung upward as much as the front portions thereof. Therefore, merely a small space is required above the rear portions of the hammers.

In a second aspect of the present invention, the interlocking mechanism of the keyboard apparatus includes a plurality of adjustment screws respectively associated with the hammers. Each of the adjustment screws includes a connecting end portion and a slidable end portion. The connecting end portion is connected to a bottom surface of one of the hammers. The slidable end portion is slidably abutted on a top surface of one of the rear portions of one of the keys. At least one part of the slidable end portion includes at least one curved surface that slides on the top surface of one of the rear portions of one of the keys so as to maintain one of the correspondence relations between one of the depression speeds of one of the keys and one of the moving speeds of one of the hammers. Moreover, the interlocking mechanism is configured so as to slide the at least one curved surface of the slidable end portion of each of the adjustment screws on the top surface of one of the keys within the range of the inclinedable angles.

In a keyboard apparatus configured as above, due to the sliding movement of the at least one curved surface, provided to the slidable end portion of each of the adjustment screws, and the top surface of each of the keys, the moving speed of each of the hammers can be inhibited from being suddenly changed with respect to the depression speed of each of the keys. Therefore, the correspondence relation between the depression speed of each of the keys and the moving speed of each of the hammers can be maintained.

It is to be noted that "the sliding movement" may indicate the movement wherein the at least one curved surface of the slidable end portion of each of the adjustment screws frictionally moves on the top surface of each of the keys. "The sliding movement" may also indicate the state wherein contact points of the at least one curved surface of the slidable end portion of each of the adjustment screws and the top surface of each of the keys change as the direction of each of the adjustment screws is changed.

In the above-described configuration, the at least one curved surface provided to the slidable end portion of each of the adjustment screws may be disposed in an opposite side of the connecting portion. In addition, the interlocking mechanism may be configured such that, as the front portions of the keys are respectively depressed toward an intermediate angle within the range of the declinable angles, directions of longitudinal shafts of the adjustment screws are respectively changed from an inclined direction, in which the longitudinal shafts are inclined with respect to a vertical direction, to a vertical direction, in which the longitudinal shafts vertically stand.

In a keyboard apparatus configured as above, when the directions of the respective adjustment screws are inclined with respect to the vertical direction, the loads applied to the rear portions of the respective keys are components of the loads of the respective hammers acting along the longitudinal shafts of the adjustment screws. The components of the loads are smaller than the loads of the respective hammers. On the other hand, when the directions of the respective adjustment screws are in the vertical direction, the loads of the respective hammers are applied to the rear end portions of the respective keys.

That is, in a keyboard apparatus configured as above, the force required for key depression is small when key depression is initiated, and becomes large as the key depression proceeds further. Therefore, the feeling of key-depression that can be obtained by a player of such keyboard apparatus in the beginning of key depression is similar to the feeling of key-depression obtained from an acoustic piano.

As a result, the keyboard apparatus configured as above can provide a player with the feeling of key-depression in the beginning of key depression, which is similar to the feeling of key-depression obtained from an acoustic piano.

The interlocking mechanism may be configured such that, as the front portions of the keys are respectively further depressed from the intermediate angle, the directions of the longitudinal shafts of the adjustment screws are respectively changed from the vertical direction to the inclined direction.

That is, in a keyboard apparatus configured as above, from the beginning of key depression and until the inclined angles of the keys reach the intermediate angles, the force required for key depression becomes large as the keys are depressed further. Once the inclined angles of the keys reach the intermediate angle, the force required for key depression becomes small as the keys are depressed still further.

As a result, the keyboard apparatus configured as above can provide a player with the feeling of key-depression, which is similar to the feeling of key-depression obtained from an acoustic piano, not only in the beginning of key depression, but also until the keys are depressed to the maximum inclined angles to which the keys can be inclined at most.

The intermediate angle may be, for example, a middle angle in the range of inclinedable angles.

If the intermediate angle is the middle angle in the range of inclinedable angles, a player can be provided with the feeling of key-depression which is furthermore similar to the feeling of key-depression of an acoustic piano.

It is to be noted that "the middle angle" may be an angle defined in the center, or in vicinity of the center, of the range of inclinedable angles.

A sliding receiving surface of each of the keys, on which the slidable end portion of each of the adjustment screws slides, may be formed so as to have a flat surface parallel to a top surface of each of the keys.

In a manufacturing process for such configuration, an angle adjustment is not necessary for milling the sliding receiving surface, after milling the top surface of each of the key by, for example, a milling machine. Therefore, the number of manufacturing processes, consequently manufacturing cost, of such keyboard apparatus can be reduced as compared to a keyboard apparatus wherein the sliding receiving surface is not in parallel to the top surface of each of the keys.

It is to be noted that flat surface approximately in parallel to the top surface of each of the keys can be included in "the flat parallel surface".

The sliding receiving surface of each of the keys, on which the slidable end portion of each of the adjustment screws slides, may be declined downward toward each of the rear portions of each of the keys.

In a keyboard apparatus configured as above, the range of angles, in which the front portions of the hammers can be swung, is large, as compared to a keyboard apparatus wherein the sliding receiving surface is configured in parallel to the top surface of each of the keys.

As a result, the front portions of the hammers can be largely swung upward, even if the front portions of the hammers are not curved upward but linearly extending forward.

The sliding receiving surface of each of the keys, on which the slidable end portion of each of the adjustment screws slides, may include a sliding receiving member.

Moreover, the sliding receiving member may include a flat surface parallel to a top surface of each of the keys on which the sliding receiving member is disposed.

In a keyboard apparatus configured as above, the sliding receiving member does not need to be formed into a special shape. Therefore, the number of manufacturing process, consequently manufacturing cost, of the sliding receiving member can be reduced.

Moreover, the sliding receiving member may include a curved surface concaved downward so that the at least one curved surface of the slidable end portion of each of the adjustment screws slides thereon so as to maintain each of the correspondence relations between each of the depression speeds of each of the keys and each of the moving speeds of each of the hammers, when each of the front portions of each of the keys is depressed.

In a keyboard apparatus configured as above, due to the sliding movement of the at least one curved surface of the slidable end portion and the curved surface of the sliding receiving member, the correspondence relation between the depression speed of each of the keys and the moving speed of each of the hammers is maintained.

Furthermore, the sliding receiving member may include a curved surface protruding upward so that the at least one curved surface of the slidable end portion of each of the adjustment screws slides thereon so as to maintain each of the correspondence relations between each of the depression speeds of each of the keys and each of the moving speeds of each of the hammers, when each of the front portions of each of the keys is depressed.

In a keyboard apparatus configured as above, due to the sliding movement of the at least one curved surface of the slidable end portion and the curved surface of the sliding receiving member, the correspondence relation between the depression speed of each of the keys and the moving speed of each of the hammers is maintained.

In a third aspect of the present invention, the interlocking mechanism includes a plurality of adjustment screws respectively associated with the keys. Each of the adjustment screws includes a connecting end portion and a slidable end portion. The connecting end portion is connected to a top surface of one of the keys. The slidable end portion is slidably abutted on a bottom surface of one of the rear portions of one of the hammers. At least one part of the slidable end portion includes at least one curved surface that slides on the bottom surface of one of the rear portions of one of the hammers so as to maintain one of the correspondence relations between one of the depression speeds of one of the keys and one of the moving speeds of one of the hammers. Moreover, the interlocking mechanism is configured so as to slide the at least one curved surface of the slidable end portion of each of the adjustment screws on the bottom surface of one of the hammers within the range of the inclinedable angles.

In a keyboard apparatus configured as above, due to the sliding movement of the at least one curved surface, provided to the slidable end portion of each of the adjustment screws, and the bottom surface of each of the hammers, the moving speed of each of the hammers can be inhibited from being suddenly changed with respect to the depression speed of each of the keys. Therefore, the correspondence relation between the depression speed of each of the keys and the moving speed of each of the hammers can be maintained.

It is to be noted that "the sliding movement" may indicate the movement wherein the at least one curved surface of the slidable end portion of each of the adjustment screws frictionally moves on the bottom surface of each of the hammers. "The sliding movement" may also indicate the state wherein contact points of the at least one curved surface of the slidable end portions of each of the adjustment screws and the bottom surface of each of the hammers change as the direction of each of the adjustment screws is changed.

The at least one curved surface provided to the slidable end portion of each of the adjustment screws may be disposed in an opposite side of the connecting portion. Moreover, the interlocking mechanism may be configured such that, as the front portions of the keys are respectively depressed toward an intermediate angle within the range of the inclinedable angles, directions of longitudinal shafts of the adjustment screws are respectively changed from an inclined direction, in which the longitudinal shafts are inclined with respect to a vertical direction, to a vertical direction, in which the longitudinal shafts vertically stand.

In a keyboard apparatus configured as above, when the directions of the respective adjustment screws are inclined with respect to the vertical direction, the loads applied to the rear portions of the respective keys are components of the loads of the respective hammers acting along the longitudinal shafts of the adjustment screws. The components of the loads are smaller than the loads of the respective hammers. On the other hand, when the direction of the respective adjustment screws are in the vertical direction, the loads of the respective hammers are applied to the rear end portions of the respective keys.

That is, in a keyboard apparatus configured as above, the force required for key depression is small, when key depression is initiated, and becomes large as the key depression proceeds further. Therefore, the feeling of key-depression that can be obtained by a player of such keyboard apparatus in the beginning of key depression is similar to the feeling of key-depression obtained from an acoustic piano.

As a result, the keyboard apparatus configured as above can provide a player with the feeling of key-depression in the beginning of key depression, which is similar to the feeling of key-depression obtained from an acoustic piano.

The interlocking mechanism may be configured such that, as the front portions of the keys are respectively further depressed from the intermediate angle, the directions of the longitudinal shafts of the adjustment screws are respectively changed from the vertical direction to the inclined direction.

That is, in a keyboard apparatus configured as above, from the beginning of key depression and until the inclined angles of the keys reach the intermediate angles, the force required for key depression becomes large as the keys are depressed further. Once the inclined angles of the keys reach the intermediate angles, the force required for key depression becomes small as the keys are depressed still further.

As a result, the keyboard apparatus configured as above can provide a player with the feeling of key-depression, which is similar to the feeling of key-depression obtained from an acoustic piano, not only in the beginning of key depression, but also until the keys are depressed to the maximum inclined angles to which the keys can be inclined at most.

The intermediate angle may be, for example, a middle angle in the range of inclinedable angles.

The sliding receiving surface of each of the hammers, on which the slidable end portion of each of the adjustment screws slides, may include a sliding receiving member.

The sliding receiving members may include a flat surface parallel to a bottom surface of each of the hammers on which the sliding receiving member is disposed.

In a keyboard apparatus configured as above, the sliding receiving member does not need to be formed into a special shape. Therefore, the number of manufacturing process, consequently manufacturing cost, of the sliding receiving member can be reduced.

The sliding receiving member may include a curved surface concaved upward so that the at least one curved surface of the slidable end portion of each of the adjustment screws slides thereon so as to maintain each of the correspondence relations between each of the depression speeds of each of the keys and each of the moving speeds of each of the hammers, when each of the front portions of each of the keys is depressed.

In a keyboard apparatus configured as above, due to the sliding movement of the at least one curved surface of the slidable end portion and the curved surface of the sliding receiving member, the correspondence relation between the depression speed of each of the keys and the moving speed of each of the hammers is maintained.

The sliding receiving member may include a curved surface protruding downward so that the at least one curved surface of the slidable end portion of each of the adjustment screws slides thereon so as to maintain each of the correspondence relations between each of the depression speeds of each of the keys and each of the moving speeds of each of the hammers, when each of the front portions of each of the keys is depressed.

In a keyboard apparatus configured as above, due to the sliding movement of the at least one curved surface of the slidable end portion and the curved surface of the sliding receiving member, the correspondence relation between the depression speed of each of the keys and the moving speed of each of the hammers is maintained.

BRIEF DESCRIPTION OF THE DRAWINGS

The invention will now be described below, by way of example, with reference to the accompanying drawings, in which:

FIGS. 4A-4C are side views showing primary portions of the keyboard apparatus according to the embodiment in regard to a sliding movement of a sliding receiving member of the key and a slidable curved surface of an adjustment screw: wherein FIG. 4A shows a state in the initial phase of key depression; wherein FIG. 4B shows a state in the intermediate phase of key depression; and wherein FIG. 4C shows a state in the final phase of key depression;

FIGS. 6A-6B are side views showing primary portions of the keyboard apparatus according to a second variation in regard to a sliding movement of a sliding receiving member of a key and a slidable curved surface of an adjustment screw; wherein FIG. 6A shows a state in an initial phase of key depression; and wherein FIG. 6B shows a state in a final phase of key depression;

FIGS. 7A-7B are side views showing primary portions of keyboard apparatus according to a third and fourth variations of the present invention in regard to a sliding movement of a sliding receiving member of the key and a slidable curved surface of an adjustment screw: wherein FIG. 7A shows a state of the sliding movement in the third variation; and wherein FIG. 7B shows a state of the sliding movement in the fourth variation;

FIGS. 11A-11B are side views showing primary portions of the convention keyboard apparatus in regard to a sliding movement of a sliding receiving member of a key and a slidable curved surface of an adjustment screw: wherein FIG. 11A shows a state of the sliding movement in a initial phase of key depression; wherein FIG. 11B shows a state of the sliding movement in a final phase of key depression.

DETAILED DESCRIPTION OF THE PREFERRED EMBODIMENT

1. Description of Structure

Figure 1:
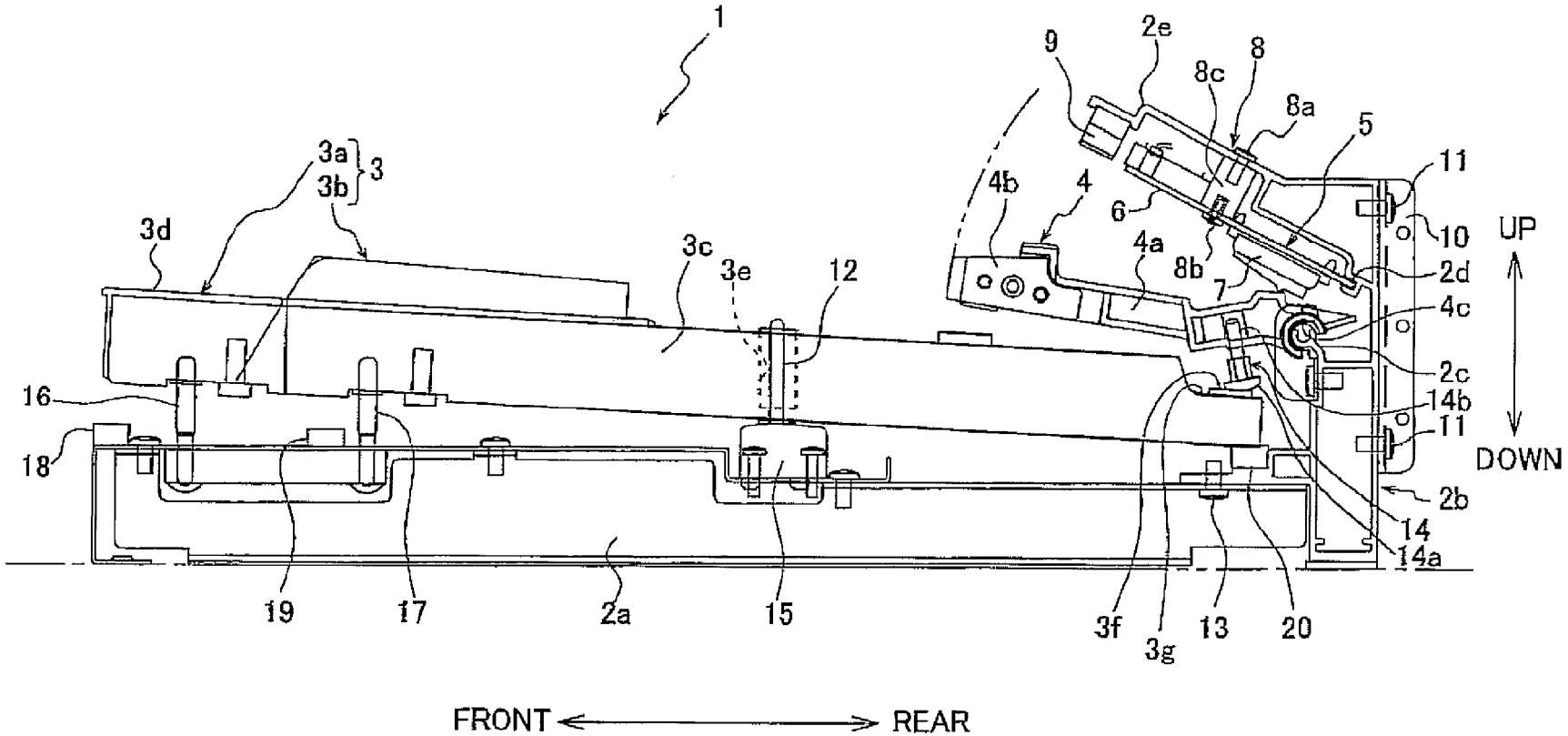
FIG. 1 is a side view showing a state of a keyboard apparatus according to an embodiment of the present invention in an initial phase of key depression.

The keyboard apparatus 1 shown in FIG. 1 includes: a plurality of keys 3 (only one key 3 having a white key 3*a* and a black key 3*b* is shown in the drawing); a lower chassis 2*a*; a rear chassis 2*b*; a plurality of hammers 4 (only one hammer 4 is shown), and a plurality of adjustment screws 14.

The lower chassis 2*a* is made of a metallic plate material, and formed by punching and bending performed in press working. The lower chassis 2*a* includes a balance rail 15 and a plurality of balance pins 12 (only one balance pin 12 is shown). The balance rail 15 is secured to the central portion of the top surface of the lower chassis 2*a* in the front-and-rear direction. The plurality of balance pins 12 is aligned in the left-to-right direction and stand on the balance rail 15.

The key 3 includes a key body 3*c* and a key cover 3*d*. The key body 3C is made of wood, and has a rectangular sectional surface. The key cover 3*d* is made of synthetic resin, and adhered to the top surface of the front portion of the key body 3*c*. A balance pin hole 3*e* is formed in the central portion of the key body 3*c*. By inserting the balance pin 12 through the balance pin hole 3*e*, the key 3 is supported by the balance pin 12 and the balance rail 15 such that the front portion of the key 3 is swingable in the up-and-down direction. On the top surface of the rear end portion of the key body 3*c*, a step surface 3*g* is formed which is lower than and approximately in parallel to the top surface of the front portion of the key body 3*c*. A sliding receiving member 3*f*, having a rectangular sectional surface, is adhered on to the step surface 3*g*. The sliding receiving member 3*f* is made of a urethane foam adhered to the top surface of the step surface 3*g*, and a slippery tape adhered to the top surface of the urethane foam.

The hammer 4 is disposed above the keys 3 so as to apply a load thereto. The hammer 4 includes a hammer body 4*a* and a pair of weight plates 4*b* (only one each is shown). The hammer body 4*a* is made of resin, and extends forward. The hammer body 4*a* is formed in a rod-shape whose front portion curved upward. The weight plates 4*b* are disposed on both lateral surfaces of the front portion of the hammer body 4*a*. In the rear end portion of the hammer body 4*a*, an arc-shaped shaft hole 4*c*, which is open backward, is formed. By the shaft hole 4*c* being engaged with a fulcrum shaft portion 2*c* of the rear chassis 2*b* (to be described later), the hammer 4 is supported by the rear chassis 2*b* such that the front portion of the hammer 4 (hammer body 4*a*) is swingable in the up-and-down direction. To the hammer body 4*a*, the adjustment screw 14 is attached in a position in vicinity of the shaft hole 4*c* disposed on the lower surface of the hammer body 4*a*.

The adjustment screw 14 is made of a material having a high rigidity, such as a metallic rod member. The adjustment screw 14 includes a base portion constituted with a longitudinal shaft having a head portion 14*a* in one end, and a male thread portion 14*b* in another end. In the opposite side of the male thread portion 14*b*, the head portion 14*a* is provided with a slidable curved surface 14*c*, having one portion of a spherical body having a uniform radius of curvature. The head portion 14*a* is also provided with an edge portion 14*d*, extending around the circumference of the slidable curved surface 14*c*. The slidable curved surface 14*c* has a radius curvature by which the slidable curved surface 14*c* slides with respect to the top surface of the sliding receiving member 3*f* so as to maintain the correspondence relation between the depression speed of the key 3 and the rotational speed of the hammer 4 when the front portion of the key 3 is depressed. It is to be noted that "the sliding movement" indicates the movement wherein the slidable curved surface 14*c* frictionally moves on the top surface of the sliding receiving member 3*f*. "The sliding movement" may also indicate the state wherein contact points of the slidable curved surface 14*c* and the top surface of the sliding receiving member 3*f* change as the direction of the adjustment screw 14 is changed. Moreover, the edge portion 14*d* has a radius curvature by which the edge portion 14*d* slides with respect to the top surface of the sliding receiving member 3*f* such that the correspondence relation between the depression speed of the key 3 and the rotational speed of the hammer 4 is hard to be maintained when the front portion of the key 3 is depressed. That is, the edge portion 14*d* has such radius curvature that the edge portion 14*d* is caught with respect to the top surface of the sliding receiving member 3*f*.

The male threaded portion 14*b* is engaged with a female thread portion (not shown), provided to the hammer body 4*a*. The adjustment screw 14 is attached to the hammer body 4*a* such that the height thereof can be adjusted. The slidable curved surface 14*c* abuts on the flat top surface of the sliding receiving member 3*f* of the key 3 associated with the hammer 4. Consequently, the hammer 4 is disposed on the top surface of the rear end portion of the corresponding key 3. The adjustment screw 14 is attached to the hammer 4 such that, when the front portion of the key 3 is not depressed, the longitudinal shaft of the adjustment screw 14 is inclined forward with respect to the vertical direction, and the front portion 14*e* of the slidable curved surface 14*c* abuts on the top surface of the sliding receiving member 3*f*.

The rear chassis 2*b* is made of one piece of an aluminum material formed by extrusion molding so as to have a hollow. The rear chassis 2*b* extends in the left-to-right direction so as to be able to support all of the hammers 4. The rear chassis 2*b* is connected to the lower chassis 2*a* by a screw 13, and secured to a key bed (not shown) by a screw (not shown). To the rear portion of the rear chassis 2*b*, a reinforcement plate 10 is attached by a screw 11. The rear chassis 2*b* also extends in the up-and-down direction, and includes a substrate attachment portion 2*e* extending from the top end of the rear chassis 2*b* in an inclined manner toward the upper front side. To the leading end portion of the substrate attachment portion 2*e*, a stopper 9 is disposed so as to restrict an upward swinging movement of the hammers 4. As well as the rear chassis 2*b*, the stopper 9 extends in the left-to-right direction so as to be provided for all of the hammers 4. Above the hammers 4, a key switch 5 is disposed so as to detect key depression state regarding each of the keys 3.

The above-described key switch 5 includes a substrate 6, and a plurality of switch bodies 7 (only one switch body 7 is shown). The substrate 6 is attached to the substrate attachment portion 2*e* by a first and a second screws 8*a*, 8*b* so as to interpose a spacer 8 therebetween, while the rear end portion of the substrate 6 is inserted into an engagement concaved portion 2*d* formed in the central portion, in the up-and-down direction, of the rear chassis 2*b*.

The switch bodies 7 are attached to the substrate 6 so as to be associated with the respective keys 3. The switch bodies 7 are connected, via the substrate 6, to a control device (not shown) which controls sound production of an electric piano. The switch bodies 7 respectively include first contacts and second contacts. The first contact is turned on when the front portion of the key 3 is depressed to a predetermined first inclined angle. The second contact is turned on when the front portion of the key 3 is further depressed to a predetermined second inclined angle, which is larger than the first inclined angle. When the front portion of the key 3 is depressed, a length of time between when the first contact is turned on and when the second contact is turned on is measured. As a result, a velocity (sound volume) is obtained depending on the key depression speed.

2. Description of Movement

As shown in FIG. 1, when the front portion of the key 3 is depressed, the front portion of the key 3 is swung downward, while the key 3 is guided by a front pin 16 for the white key 3*a*, or a front pin 17 for the black key 3*b*, so as not to be swung in the left-to-right direction.

When the front portion of the key 3 is further depressed, the rear portion of the key 3 pushes up the adjustment screw 14. The hammer 4 is swung around the shaft hole 4*c* so as to move the weight plate 4*b* upward. While the hammer 4 is swung in this direction, the weight of the weight plate 4*b* works so to prevent the swinging movement of the hammer body 4*a*. In the initial phase (see FIG. 1) of key depression, as shown in FIG. 4A, the longitudinal shaft of the adjustment screw 14 is inclined forward with respect to the vertical direction, and the front portion 14*e* of the slidable curved surface 14*c* slides on the top surface of the sliding receiving member 3*f*. In this state, the load applied to the rear end portion of the key 3 is a component of the load of the hammer 4 acting along the longitudinal shaft of the adjustment screw 14. The component of the load is smaller than the load of the hammer 4.

Figure 2:
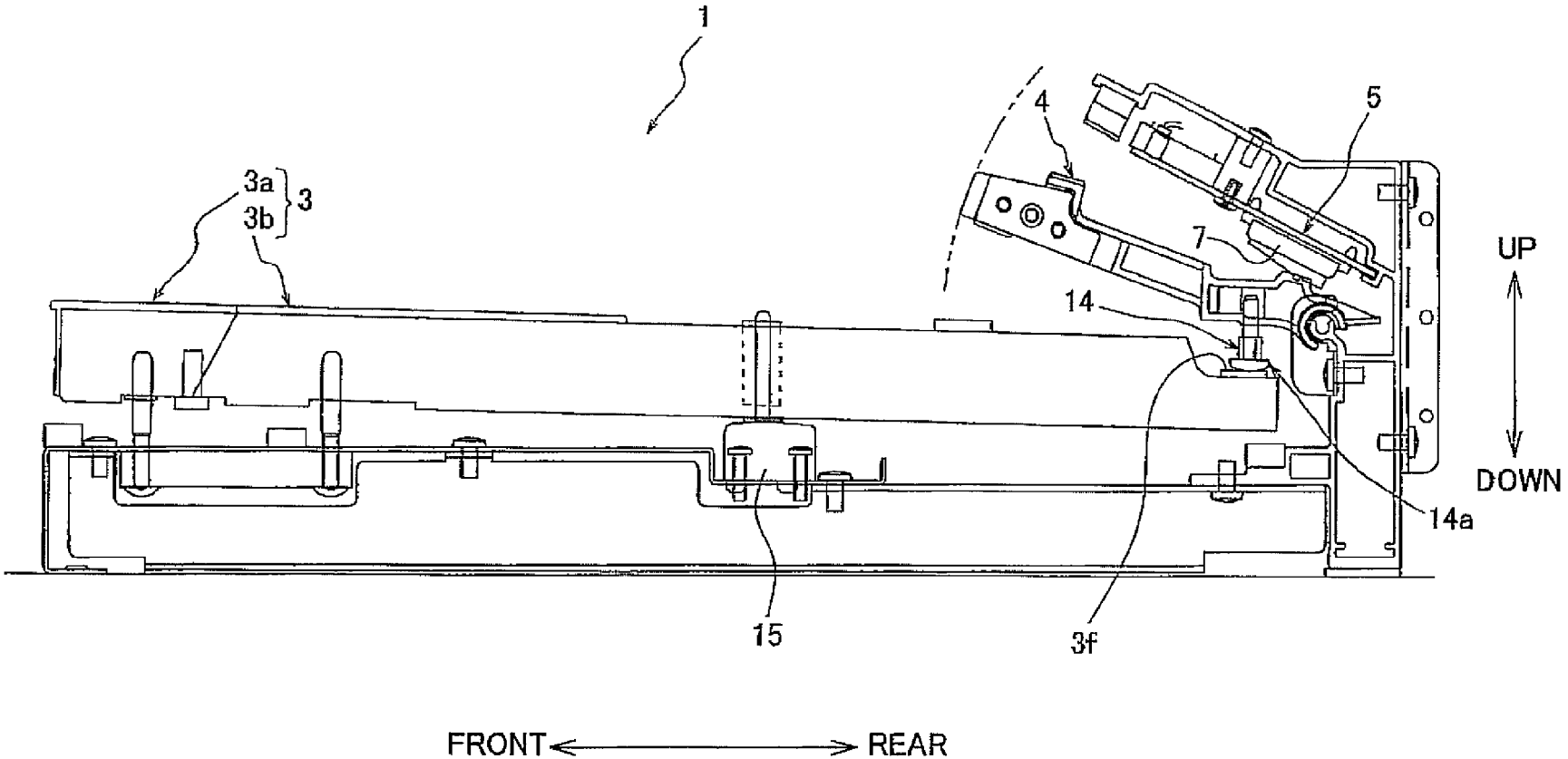
FIG. 2 is a side view showing a state of the keyboard apparatus according to the embodiment in an intermediate phase of key depression.

When the front portion of the key 3 is furthermore depressed to an intermediate angle within the range of inclinedable angles of the key 3 (in the present embodiment, to the middle angle in the range of inclinedable angles or in vicinity of the middle angle) (to be referred to as the intermediate phase of key depression, see FIG. 2), as shown in FIG. 4B, the longitudinal shaft of the adjustment screw 14 stands approximately upright in the vertical direction, and the central portion 14*f* of the slidable curved surface 14*c* slides on the top surface of the sliding receiving member 3*f*. In this state, the load applied to the rear end portion of the key 3 is the load of the hammer 4.

Figure 3:
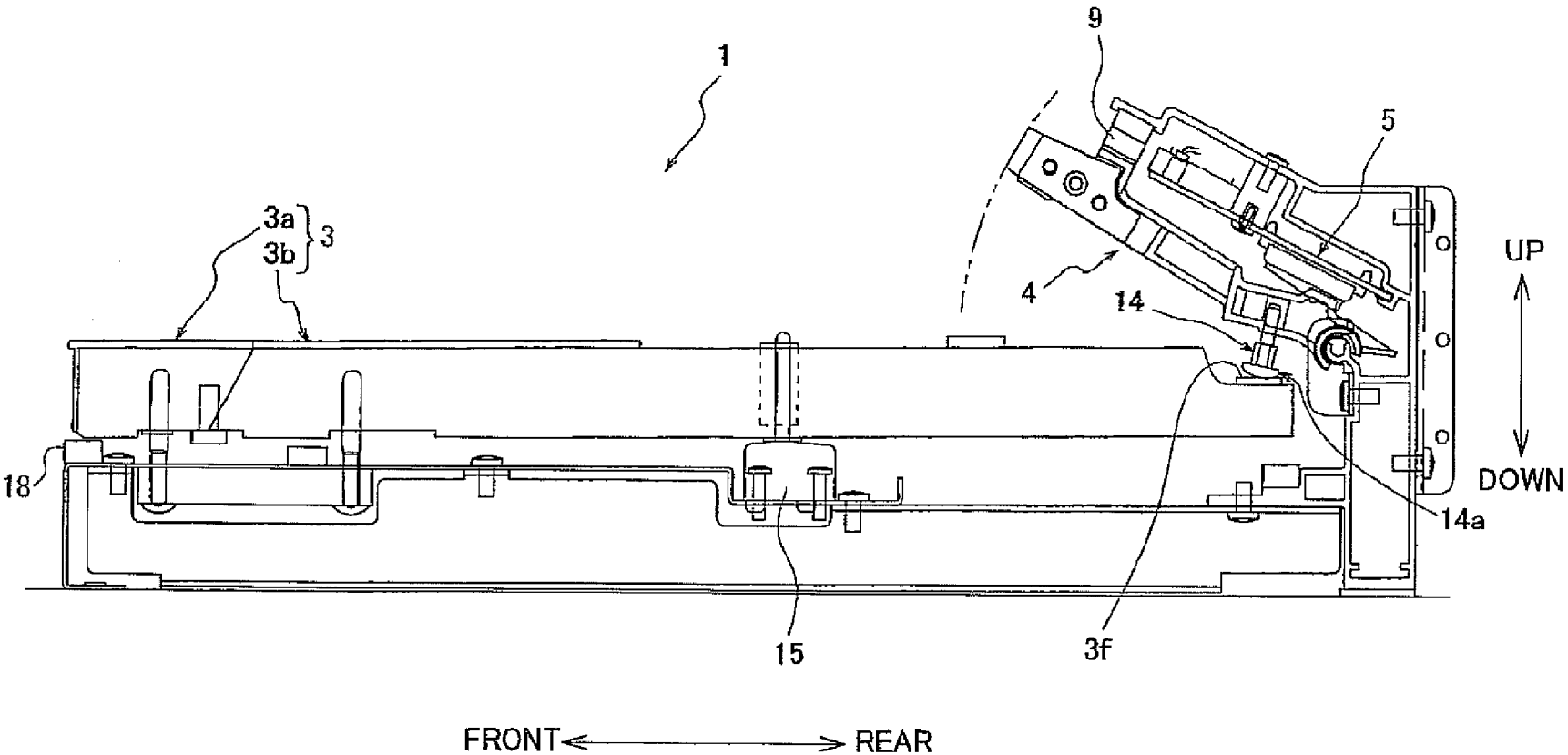
FIG. 3 is a side view showing a state of the keyboard apparatus according to the embodiment in a final phase of key depression.

Then, the depression of the front portion of the key 3 is restricted by the bottom surface of the key 3 abutting on a lower limit stopper 18 for the white key 3*a*, or a lower limit stopper 19 for the black key 3*b*, attached to the lower chassis 2*a* (see FIG. 3).

The swinging movement of the hammer 4 is restricted by the top surface of the leading end portion of the hammer 4 abutting on the stopper 9. In the final phase (see FIG. 3) of key depression, as shown in FIG. 4C, the longitudinal shaft of the adjustment screw 14 is inclined backward with respect to the vertical direction. The rear portion 14*g* of the slidable curved surface 14*c* slides on the top surface of the sliding receiving member 3*f*. In this state, the load applied to the rear end portion of the key 3 is a component of load of the hammer 4 acting along the longitudinal shaft of the adjustment screw 14. The component of load is smaller than the load of the hammer 4.

In conjunction with the swinging movement of the hammer 4, the switch body 7 of the key switch 5 is pressed by the top surface of the rear portion of the hammer body 4*a*. As a result, a depression state of the key 3 is detected, and sound production of an electronic piano is controlled by the control device corresponding to the depression speed.

That is, in the keyboard apparatus 1, when the front portion of the key 3 is depressed the head portion 14*a* of the adjustment screw 14 slides on the top surface of the slide receiving member 3*f* in a portion of the slidable curved surface 14*c* between the front portion 14*e* and the rear portion 14*g*. Therefore, the swinging speed of the hammer 4, with respect to the depression speed of the key 3, is inhibited from being suddenly changed. Due to a sudden change in the swinging speed of the hammer 4 being inhibited, the correspondence relation between the depression speed of the key 3 and the swinging speed of the hammer 4 is maintained.

When the front portion of the key 3 is released from the depressed state, due to the weight of the plate 4*b*, the front portion of the hammer body 4*a* is swung downward. In conjunction with the swinging movement of the hammer body 4*a*, the front portion of the key 3 is swung in a direction opposite to the above-described direction in key depression. Then, the inclined angle of the key 3 is returned to the inclined angle in the initial phase of key depression. This swinging movement of the front portion of the key 3 is restricted by the bottom surface of the key 3 abutting on an upper limit stopper 20 attached to the rear end portion of the upper portion of the lower chassis 2*a* (the state shown in FIG. 1). The swinging movement of the hammer 4 is restricted by the edge portion 14*d* in the front portion of the adjustment screw 14 abutting on the top surface of the sliding receiving member 3*f*.

3. Description of Effect

In the keyboard apparatus 1, the correspondence relation between the depression speed of the respective keys 3 and the swinging speed of the hammers 4 associated with the respective keys 3 is maintained within the range of the inclinedable angles of the respective keys 3. As a result, sound with a suitable velocity can be produced with respect to the depression speed of the respective keys 3.

In the keyboard apparatus 1, the respective hammers 4 extend forward, and are supported by the rear chassis 2*b* such that the front portions of the respective hammers 4 are swingable in the up-and-down direction. Therefore, the rear portions of the respective hammers 4 are not swung upward as largely as the front portions of the respective hammers 4. As a result, a space required above the rear portions of the respective hammers 4 can be small in the keyboard apparatus 1.

In the keyboard apparatus 1, from an initiation of key depression until the inclined angles of the respective keys 3 reach the middle angle, the force required for depressing the respective keys 3 becomes large as the keys 3 are depressed further. Once the inclined angles of the respective keys 3 reach the middle angle, the force required for depression the respective keys 3 becomes small as the keys 3 are depressed still further.

Therefore, the keyboard apparatus 1 can provide a player with a feeling of key-depression similar to the feeling of key-depression obtained from an acoustic piano.

In the keyboard apparatus 1, the step surface 3*g* is formed so as to be approximately in parallel to the top surface of the front portion of the key body 3*c*. In a manufacturing process for such configuration, an angle adjustment is not necessary for milling the step surface 3*g*, after milling the top surface of the key body 3*c* by, for example, a milling machine. Therefore, the number of manufacturing processes, consequently manufacturing cost, of the keys 3 can be reduced as compared to a keyboard apparatus wherein the step surfaces 3*g* are not in parallel to the top surfaces of the key bodies 3*c*.

In the keyboard apparatus 1, since the top surfaces of the sliding receiving members 3*f* are flat, the sliding receiving members 3*f* do not need to be formed into special shapes. Therefore, the number of manufacturing processes, consequently manufacturing cost, of the sliding receiving members 3*f* can be reduced.

[First Variation]

In the above-described embodiment, the top surface of the rear end portion of the key body 3*c* is provided with the step surface 3*g* approximately in parallel to the top surface of the front portion of the key body 3*c*. Alternatively, the top surface of the rear end portion of the key body 3*c* may be provided with a form different from the step surface 3*g*.

Figure 5:
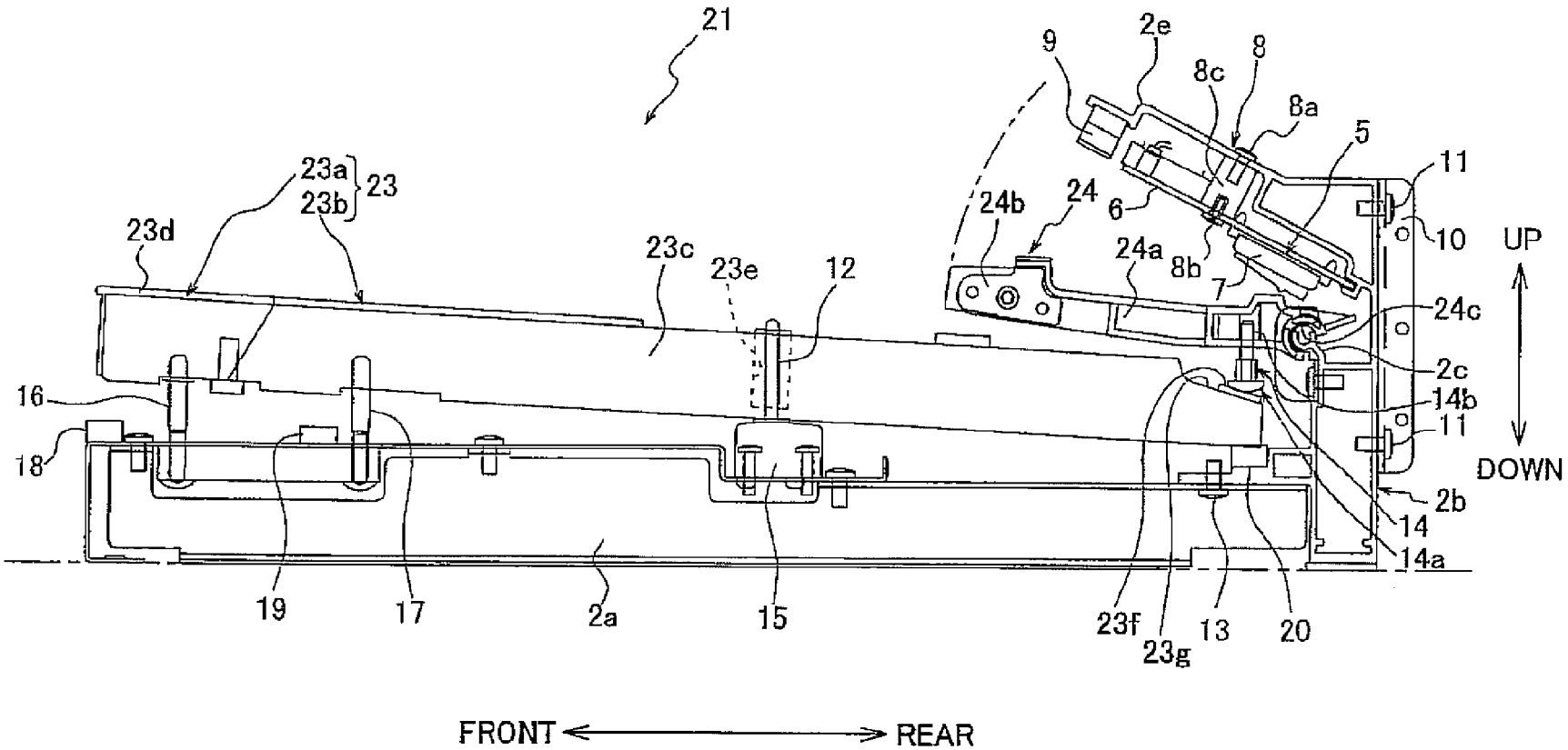
FIG. 5 is a side view showing a keyboard apparatus according to a first variation of the present invention.

In the keyboard apparatus 21 according to the first variation shown in FIG. 5, the top surface of the rear end portion of the key body 23*c* is provided with a declined surface 23*g* declined downward toward the rear portion of the key body 23*c*.

Figure 9:
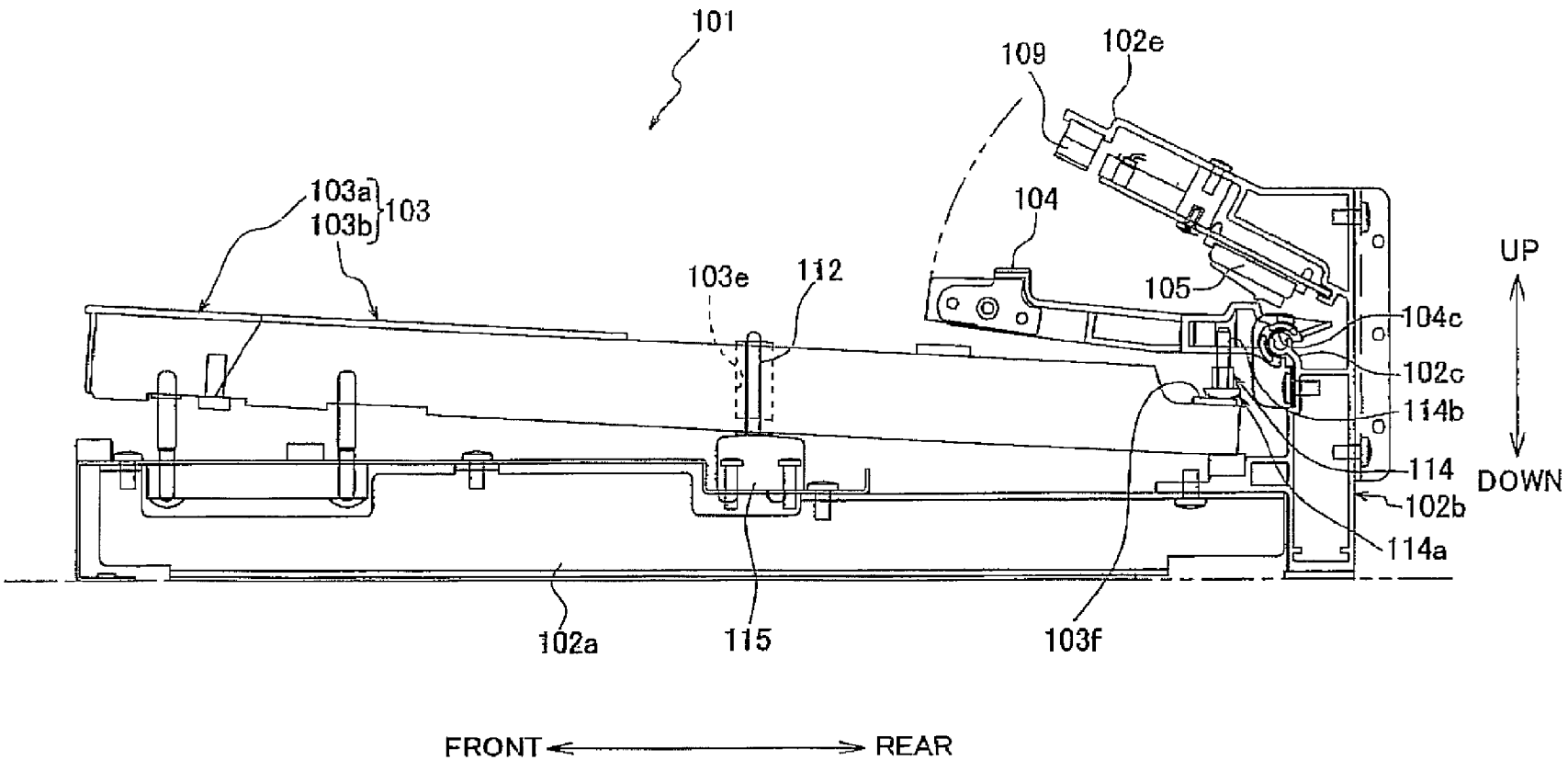
FIG.9 RELATED ART
FIG. 9 is a side view showing a state of a conventional keyboard apparatus in an initial phase of key depression.
Figure 10:
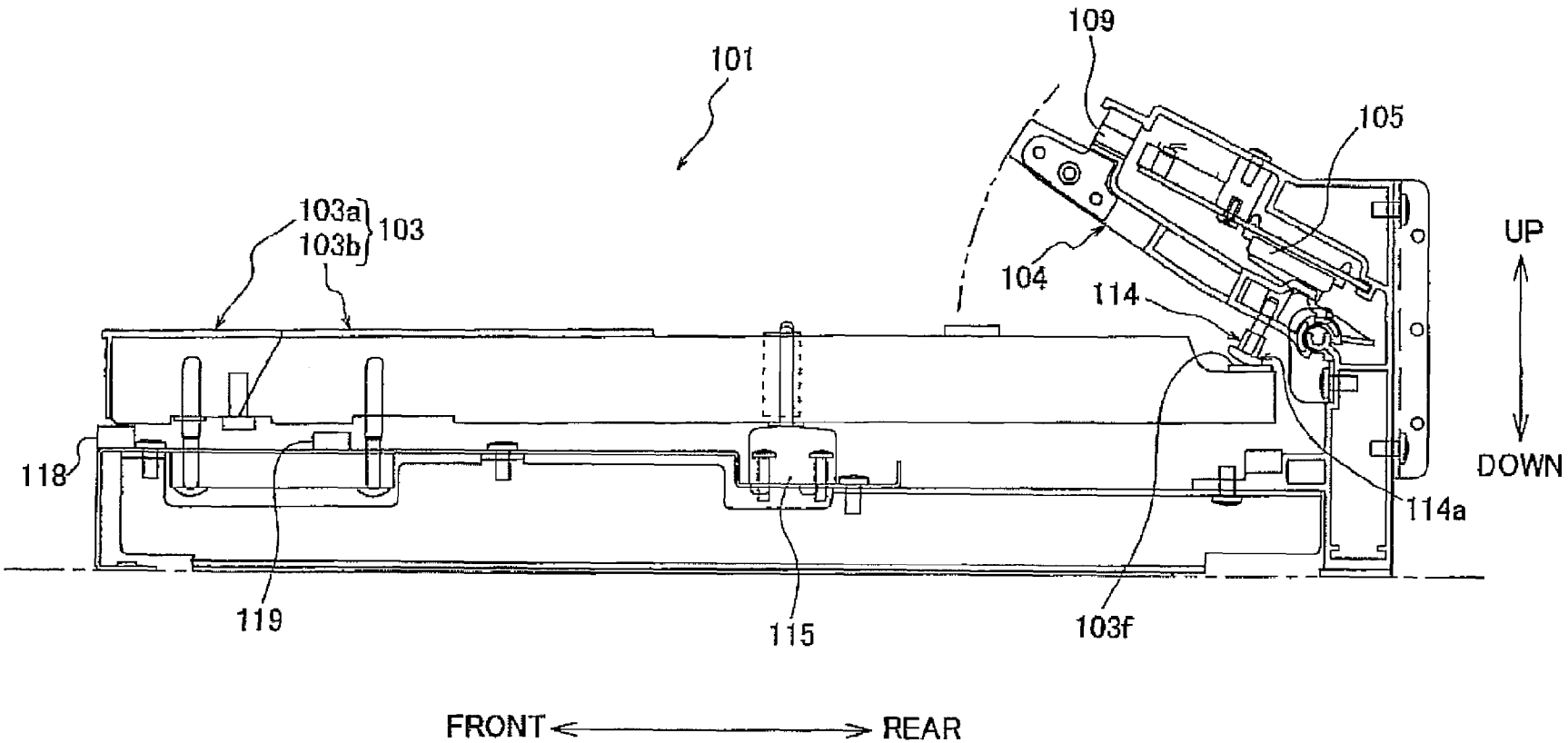
FIG.10 RELATED ART
FIG. 10 is a side view showing a state in the conventional keyboard apparatus wherein the front portion of the key is depressed to a maximum inclined angle.

In the keyboard apparatus 21, due to the declined surface 23*g*, the range of swingable angles of the front portion of the hammer 24 becomes larger than in the keyboard apparatus 1. Therefore, the shape of the hammer 24 may be formed in a simple linear shape as compared to the shape of the hammer 4 of the above-described embodiment. In a case wherein the hammer 24 is made by molding with synthetic resin, the number of manufacturing processes for making a molding die can be decreased, and, therefore, the manufacturing cost can be reduced. Moreover, since the shape of the hammer 24 may be the same as the shape of the hammer 104 of the conventional keyboard apparatus 101 (see FIG. 9), in a case wherein the hammer 104 is made by molding with synthetic resin, the hammer 24 can be made by using the molding die of the hammer 104. A new molding die is not necessary for making the hammer 24. Therefore, an increase in the manufacturing cost can be avoided.

[Second Variation]

In the second variation, the adjustment screw 14 in the keyboard apparatus 1 according to the above-described embodiment is substituted with an adjustment screw 214 shown in FIGS. 6A, 6B.

As shown in FIGS. 6A, 6B, the length of the curved surface of a slidable curved surface 214*c* provided to the a head portion 214*a* of the adjustment screw 214 is larger than the length of the curved surface of the slidable curved surface 14*c* provided to the head portion 14*a* (shown by dot-dash lines in FIG. 6) of the adjustment screw 14. The adjustment screw 214 is positioned such that the longitudinal shaft of the adjustment screw 214 stands upright in the vertical direction in the initial phase of key depression, and such that the longitudinal shaft of the adjustment screw 214 is inclined backward with respect to the vertical direction.

In this case, the shape of the hammer 4 can be formed in a liner shape as compared to the shape in the above-described embodiment. In a case wherein the hammer 4 is made by molding with synthetic resin, the number of manufacturing processes for making a molding die can be decreased, and, therefore, the manufacturing cost can be reduced. Moreover, since the shape of the hammer 4 can be the same as the shape of the hammer 104 of the conventional keyboard apparatus 101 (see FIG. 9), in a case wherein the hammer 104 is made by molding with synthetic resin, the hammer 4 can be made by using the molding die of the hammer 104. A new molding die is not necessary for making the hammer 4. Therefore, an increase in the manufacturing cost can be avoided.

It goes without saying that the adjustment screw 214 may be disposed such that the longitudinal shaft of the adjustment screw 214 is inclined forward with respect to the vertical direction in the initial phase of key depression, such that the longitudinal shaft of the adjustment screw 214 stand upright in the vertical direction in the intermediate phase of key depression, and such that the longitudinal shaft of the adjustment screw 214 is inclined backward with respect to the vertical direction.

[Third and Fourth Variations]

The top surface of the sliding receiving member 3*f* of the above-described embodiment is formed into a flat surface. However, the top surface of a sliding receiving member may be formed into a shape other than a flat surface.

For example, the top surface of the sliding receiving member 3*f* may be formed into a curved surface concaved downward so that, when the front portion of the key 3 provided with such sliding receiving member 3*f* is depressed, the slidable curved surface 14*c* of the adjustment screw 14 associated with the key 3 slides on the top surface of the sliding receiving member 3*f* so as to maintain the correspondence relation between the depression speed of the key 3 and the rotational speed of the hammer 4 associated with the key 3.

Figure 7A:
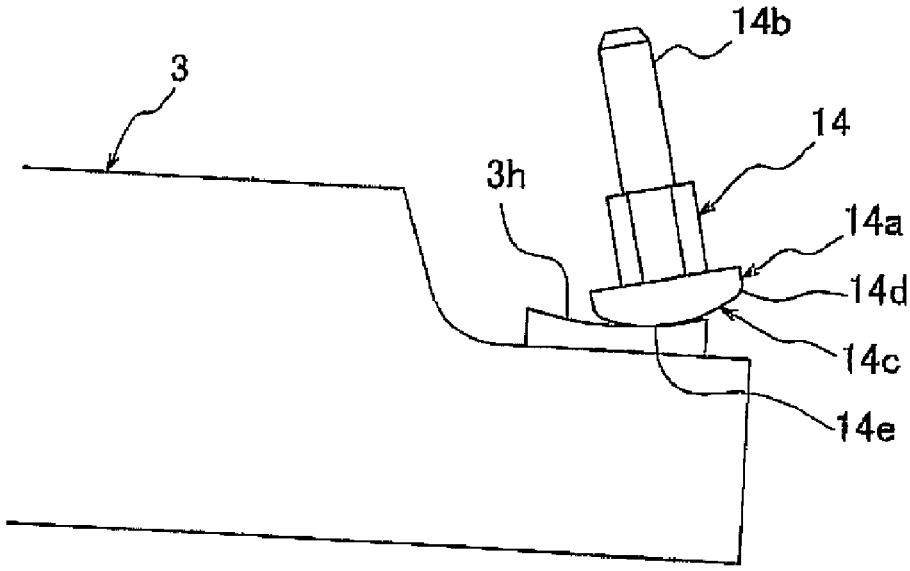

The third variation is one example of such configuration. As shown in FIG. 7A, the top surface of the sliding receiving member 3*h* is provided with a curved surface concaved downward. The curved surface has a radius of the curvature larger than the radius of the curvature of the slidable curved surface 14*c*. The length of the curved surface is equivalent to or larger than the length of the curved surface of the slidable curved surface 14*c*. When the front portion of the key 3 is depressed, the slidable curved surface 14*c* slides on the top surface of the slide receiving member 3*h* in a portion of the slidable curved surface 14*c* between the front portion 14*e* and the rear portion 14*g*.

In this case, since the contact area of the slidable curved surface 14*c* and the top surface of the sliding receiving member 3*h* is smaller than the contact area in the above-described embodiment, the friction resistance becomes smaller than in the above-described embodiment. As a result, the sliding movement of the slidable curved surface 14*c* and the top surface of the sliding receiving member 3*h* is maintained, and thus, the correspondence relation between the depression speed of the key 3 and the swinging speed of the hammer 4 can be maintained.

Alternatively, the top surface of the sliding receiving member 3*f* may be formed into a curved surface projecting upward so that, when the front portion of the key 3 provided with such sliding receiving member 3*f* is depressed, the slidable curved surface 14*c* of the adjustment screw 14 associated with the key 3 slides on the top surface of the sliding receiving member 3*f* so as to maintain the correspondence relation between the depression speed of the key 3 and the rotational speed of the hammer 4 associated with the key 3.

Figure 7B:
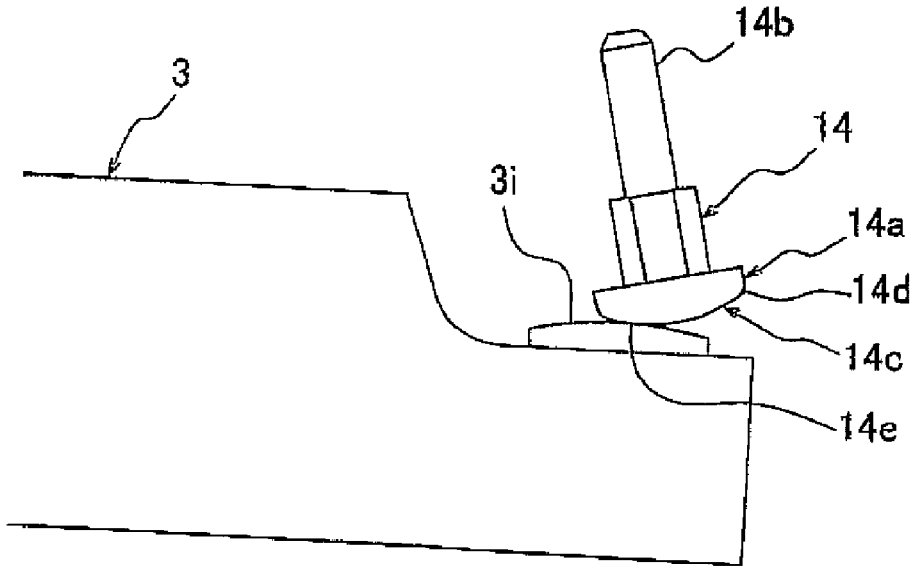
Figure 8:
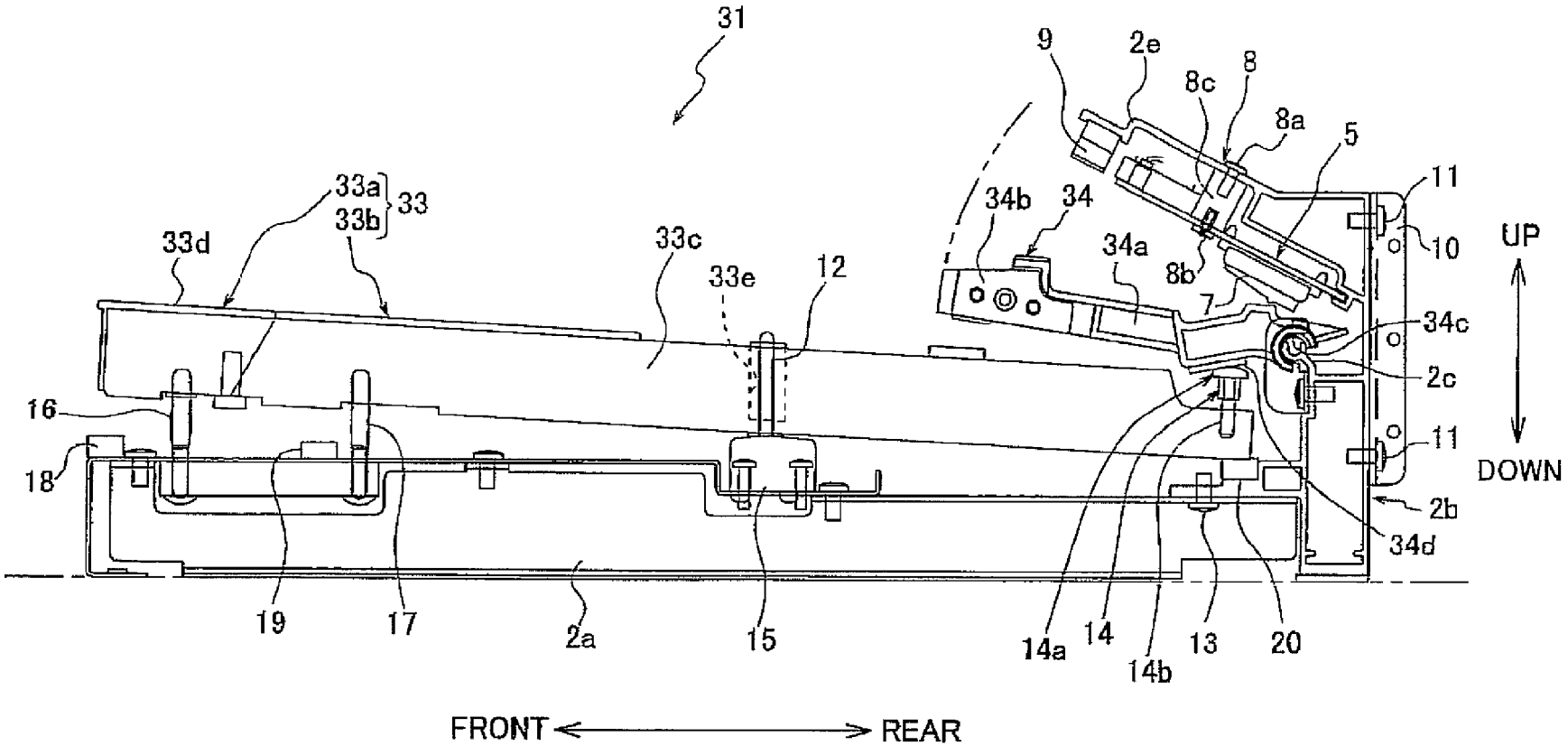
FIG. 8 is a side view showing a keyboard apparatus according to a fifth variation of the present invention.

The fourth variation is one example of such configuration. As shown in FIG. 7B, the top surface of the sliding receiving member 3*i* is provided with a curved surface projecting upward. The length of the curved surface is equivalent to or larger than the length of the curved surface of the slidable curved surface 14*c*.

In this case, since the contact area of the slidable curved surface 14*c* and the top surface of the sliding receiving member 3*i* is smaller than the contact area in the above-described embodiment the friction resistance becomes smaller than in the above-described embodiment. As a result, the sliding movement of the slidable curved surface 14*c* and the top surface of the sliding receiving member 3*i* is maintained, and thus, the correspondence relation between the depression speed of the key 3 and the swinging speed of the hammer 4 can be maintained.

[Fifth Variation]

In the keyboard apparatus 1 according to the above-described embodiment, the head portion 14*a* of the adjustment screw 14 slides on the top surface of the sliding receiving member 3*f* provided on the key body 3*c*, and the male thread portion 14*b* of the adjustment screw 14 is attached to the bottom surface of the hammer body 4*a*.

In a keyboard apparatus 31 according to the fifth variation, the head portion 14*a* of the adjustment screw 14 slides on the bottom surface of the rear end portion of the hammer body 34*a*, and the male thread portion 14*b* of the adjustment screw 14 is attached to the top surface of the rear end portion of a key body 33*c*.

In this case, the male thread portion 14*b* of the adjustment screw 14 is engaged, from above, with the female thread portion of the key body 33*c*. In this way of engagement, wherein the adjustment screw 14 is engaged with the key body 33*c* from above, attachment of the adjustment screw 14 and adjustment of the height of the adjustment screw 14 becomes easier, as compared to a case wherein the adjustment screw 14 is engaged with the female thread portion provided to a hammer from below. As a result, the number of assembling processes and, consequently, the manufacturing cost can be reduced, as compared to a case wherein the adjustment screw 14 is provided to a hammer.

It is to be noted that, in the foregoing configuration, one of the above-described sliding receiving members 3*f*, 3*h*, 3*i* may be provided to the bottom surface of the rear end portion of the hammer body 34*a*.

[Other Variations]

One portion of the head portion 14*a* of the adjustment screw 14 in the above described embodiment is formed approximately in a spherical shape. Alternatively, the entire portion of the head portion 14*a* may be formed approximately in a spherical shape. Since the edge portion 14*d* is not formed in the head portion 14*a* of the adjustment screw 14 in this case, the sliding movement of the slidable curved surface 14*c* and the top surface of the sliding receiving member 3*f* can be reliably maintained.

In the above-described embodiment, the head portion 14*a* of the adjustment screw 14 has a uniform radius of the curvature. However, the radius curvature may not be necessarily uniform as long as the head portion 14*a* slides on the top surface of the sliding receiving member 3*f* so as to maintain the correspondence relation between the depression speed of the key 3 and the rotational speed of the hammer 4 associated with the hammer 4.

Although specific embodiment and modifications have been illustrated and described herein, it is to be understood that the above description is intended to be illustrative, and not restrictive. Combinations of the above embodiment, the above modifications, and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

What is claimed is:

1. A keyboard apparatus comprising:

a plurality of keys;

a plurality of hammers respectively associated with the keys such that each hammer applies a load to a respective key;

a first supporting portion that supports the keys such that front portions of the keys are swingable in an up-and-down direction;

a second supporting portion that supports the hammers above the keys such that the hammers are movable in the up-and-down direction;

an interlocking mechanism that conveys weight of the hammers respectively to rear portions of the keys, and causes an upward movement of the hammers, when front portions of the keys are depressed and the rear portions of the keys are swung upward, the interlocking mechanism includes a plurality of adjustment screws respectively associated with the plurality of the hammers, each of the adjustment screws includes a connecting end portion and a slidable end portion;

the connecting end portion is connected to one of a bottom surface of one of the hammers and a top surface of the rear portion of one of the keys;

the slidable end portion includes at least one curved surface that at least partially abuts and slides on the other of the bottom surface of one of the hammers and the top surface of the rear portion of one of the keys so as to maintain correspondence relations between depression speeds of one of the keys and moving speeds of one of the hammers; and the at least one curved surface of the slidable end portion slides on the other of the bottom surface of one of the hammers and the top surface of the rear portion of one of the keys within a range of inclined angles in which the keys are swingable when the front portions of the keys are depressed.

2. The keyboard apparatus as set forth in claim 1, wherein the hammers extend forward in a front-to-rear direction, wherein the second supporting portion supports the hammers such that front portions of the hammers are swingable in the up-and-down direction, and wherein the interlocking mechanism is configured such that, when the front portions of the keys are depressed, front portions of the hammers are respectively moved upward.

3. The keyboard apparatus as set forth in claim 1, wherein the at least one curved surface provided to the slidable end portion of each of the adjustment screws is disposed in an opposite side of the connecting portion, the interlocking mechanism is configured such that, as the front portions of the keys are respectively depressed toward an intermediate angle within the range of the declinable angles, directions of longitudinal shafts of the adjustment screws are respectively changed from an inclined direction, in which the longitudinal shafts are inclined with respect to a vertical direction, to a vertical direction, in which the longitudinal shafts vertically stand.

4. The keyboard apparatus as set forth in claim 3 wherein the interlocking mechanism is configured such that, as the front portions of the keys are respectively further depressed from the intermediate angle, the directions of the longitudinal shafts of the adjustment screws are respectively changed from the vertical direction to the inclined direction.

5. The keyboard apparatus as set forth in claim 3 wherein the intermediate angle is a middle angle in the range of inclinedable angles.

6. The keyboard apparatus as set forth in claim 1, wherein the slidable end portion is slidably abutted on the top surface of the rear portion of one of the keys; and a sliding receiving surface of each of the keys, on which the slidable end portion of each of the adjustment screws slides, is formed so as to have a flat surface parallel to a top surface of each of the keys.

7. The keyboard apparatus as set forth in claim 1, wherein the slidable end portion is slidably abutted on the top surface of the rear portion of one of the keys; and a sliding receiving surface of each of the keys, on which the slidable end portion of each of the adjustment screws slides, is declined downward toward each of the rear portions of each of the keys.

8. The key board apparatus as set forth in claim 1, wherein the slidable end portion is slidably abutted on the top surface of the rear portion of one of the keys; and a sliding receiving surface of each of the keys, on which the slidable end portion of each of the adjustment screws slides, comprises a sliding receiving member, and the sliding receiving member includes a flat surface parallel to a top surface of each of the keys on which the sliding receiving member is disposed.

9. The keyboard apparatus as set forth in claim 1, wherein the slidable end portion is slidably abutted on the top surface of the rear portion of one of the keys; and a sliding receiving surface of each of the keys, on which the slidable end portion of each of the adjustment screws slides, comprises a sliding receiving member, and the sliding receiving member includes a curved surface concaved downward so that the at least one curved surface of the slidable end portion of each of the adjustment screws slides thereon so as to maintain each of the correspondence relations between each of the depression speeds of each of the keys and each of the moving speeds of each of the hammers, when each of the front portions of each of the keys is depressed.

10. The keyboard apparatus as set forth in claim 1, wherein the slidable end portion is slidably abutted on the top surface of the rear portion of one of the keys; and a sliding receiving surface of each of the hammers, on which the slidable end portion of each of the adjustment screws slides, comprises a sliding receiving member, and the sliding receiving member includes a curved surface protruding upward so that the at least one curved surface of the slidable end portion of each of the adjustment screws slides thereon so as to maintain each of the correspondence relations between each of the depression speeds of each of the keys and each of the moving speeds of each of the hammers, when each of the front portions of each of the keys is depressed.

11. The keyboard apparatus as set forth in claim 1, wherein the slidable end portion is slidably abutted on the bottom surface of one of the hammers;

a sliding receiving surface of each of the hammers, on which the slidable end portion of each of the adjustment screws slides, comprises a sliding receiving member, and the sliding receiving member includes a flat surface parallel to a bottom surface of each of the hammers on which the sliding receiving member is disposed.

12. The keyboard apparatus as set forth in claim 1, wherein the slidable end portion is slidably abutted on the bottom surface of one of the hammers;

a sliding receiving surface of each of the hammers, on which the slidable end portion of each of the adjustment screws slides, comprises a sliding receiving member, and the sliding receiving member includes a curved surface concaved upward so that the at least one curved surface of the slidable end portion of each of the adjustment screws slides thereon so as to maintain each of the correspondence relations between each of the depression speeds of each of the keys and each of the moving speeds of each of the hammers, when each of the front portions of each of the keys is depressed.

13. The keyboard apparatus as set forth in claim 1, wherein the slidable end portion is slidably abutted on the bottom surface of one of the hammers;

a sliding receiving surface of each of the hammers, on which the slidable end portion of each of the adjustment screws slides, comprises a sliding receiving member, and the sliding receiving member includes a curved surface protruding downward so that the at least one curved surface of the slidable end portion of each of the adjustment screws slides thereon so as to maintain each of the correspondence relations between each of the depression speeds of each of the keys and each of the moving speeds of each of the hammers, when each of the front portions of each of the keys is depressed.

14. The keyboard apparatus as set forth in claim 1, wherein the slidable end portion includes an edge portion at least one end of the at least one curved surface, the slidable end portion completes sliding, within the range of inclined angles, before the edge portions abut the other of the bottom surface of one of the hammers and the top surface of the rear portion of one of the keys.

15. The keyboard apparatus as set forth in claim 1, wherein the slidable end portion is at least partially a near spherical body.

16. The keyboard apparatus as set forth in claim 1, wherein each of the hammers includes a weighted element such that the hammers apply a load to each of the keys.

17. The keyboard apparatus as set forth in claim 1, wherein a plurality of key switches, which detect key depression states, each of the key switches being disposed above each of the hammers, and the each of the hammers moves upward to depress the corresponding key switch.

* * * * *